US009278045B2

(12) United States Patent
Scerbo

(10) Patent No.: US 9,278,045 B2
(45) Date of Patent: Mar. 8, 2016

(54) FACIAL REJUVENATING APPARATUS

(76) Inventor: Louis Scerbo, Nutley, NJ (US)

( * ) Notice: Subject to any disclaimer, the term of this patent is extended or adjusted under 35 U.S.C. 154(b) by 596 days.

(21) Appl. No.: 13/594,017

(22) Filed: Aug. 24, 2012

(65) Prior Publication Data

US 2013/0053737 A1 Feb. 28, 2013

Related U.S. Application Data

(60) Provisional application No. 61/527,651, filed on Aug. 26, 2011.

(51) Int. Cl.

| | |
|---|---|
| ***A61H 23/02*** | (2006.01) |
| *A61H 23/04* | (2006.01) |
| *A61H 35/00* | (2006.01) |

(52) U.S. Cl.

CPC ..... *A61H 23/02* (2013.01); *A61H 23/04* (2013.01); *A61H 35/008* (2013.01); *A61H 2201/0107* (2013.01); *A61H 2201/0138* (2013.01); *A61H 2201/0157* (2013.01); *A61H 2201/0207* (2013.01); *A61H 2201/105* (2013.01); *A61H 2201/1654* (2013.01); *A61H 2201/1676* (2013.01); *A61H 2201/5007* (2013.01); *A61H 2205/022* (2013.01)

(58) Field of Classification Search

CPC ..... A61H 5/00; A61H 5/005; A61H 23/00–2023/045; A61H 35/008; A61H 35/02; A61H 35/04; A61H 2205/02–2205/028

See application file for complete search history.

(56) References Cited

U.S. PATENT DOCUMENTS

| | | | | | |
|---|---|---|---|---|---|
| 1,007,636 | A | * | 10/1911 | Beck | 128/201.11 |
| 1,627,618 | A | * | 5/1927 | Paul | 601/15 |
| 1,705,467 | A | * | 3/1929 | Battenfeld | 607/84 |
| 3,323,517 | A | * | 6/1967 | Keller | 601/18 |
| 3,557,781 | A | * | 1/1971 | Kaye, Sr. | 601/71 |
| 4,052,981 | A | * | 10/1977 | Bachmann | 601/71 |
| 4,666,148 | A | * | 5/1987 | Crawford | 482/11 |
| 4,732,140 | A | | 3/1988 | Stoffregen | |
| 5,072,724 | A | | 12/1991 | Marcus | |
| 5,928,262 | A | * | 7/1999 | Harber | 606/204.35 |
| 2004/0025243 | A1 | * | 2/2004 | Chien | 4/525 |
| 2006/0287615 | A1 | * | 12/2006 | Yu | 601/15 |
| 2008/0058915 | A1 | * | 3/2008 | Chang | 607/140 |
| 2009/0254014 | A1 | * | 10/2009 | Son | 601/134 |
| 2014/0221880 | A1 | * | 8/2014 | Yang | 601/18 |

FOREIGN PATENT DOCUMENTS

| | | |
|---|---|---|
| JP | 2005-118527 | 5/2005 |
| WO | 2006138298 | 12/2006 |

OTHER PUBLICATIONS

International Search Report.

* cited by examiner

*Primary Examiner* — Valerie L Skorupa

(74) *Attorney, Agent, or Firm* — Gerald E. Hespos; Michael J. Porco; Matthew T. Hespos

(57) ABSTRACT

A facial rejuvenating apparatus includes a pad having a concavity in an upper surface thereof. The concavity is configured to receive a human face. A pad breathing hole extends through the pad at a location to align with a nose of the face positioned in the concavity. A nonporous lining is provided to nest with the concavity in the pad. A lining breathing opening registers with the pad breathing opening. Stimulators, such as vibrators, are mounted in the pad to stimulate the face of a person using the apparatus.

8 Claims, 4 Drawing Sheets

FACIAL REJUVENATING APPARATUS

CROSS-REFERENCE TO RELATED APPLICATION

This application claims priority on U.S. Provisional Patent Appl. No. 61/527,651 filed on Aug. 26, 2011, the entire disclosure of which is incorporated herein by reference.

BACKGROUND OF THE INVENTION

1. Field of the Invention

This invention relates to an apparatus for stimulating and rejuvenating facial skin and tissue.

2. Description of the Related Art

Vibrating and massage devices for are well known in the prior art and have been incorporated into many known objects. Such devices are generally used by people who need temporary relief from sore or strained muscles and do not have the time or resources to engage a professional masseuse. For instance, massage chairs and massage pads for chairs are popular products that offer quick relief. A massage chair has a series of vibrators disposed therein and is attached to an electrical connection. A user may have a control device to control the speed or location of vibration to bring relief to an affected area. Massage chairs and pads are ideal for working professionals who may sit in an uncomfortable position or those who engage in strenuous activity. However, massage chairs and pads can only bring relief to the back, neck and shoulders and are ineffectual for face massages.

Several products have been developed for massaging a face. Generally, these devices are in the form of a handheld wand with at least one vibrating element disposed at an end. A user manually directs the vibrating element towards a desired area and applies pressure. There are several important benefits to using a face massager. Most importantly, the vibrations help bring blood to the surface and give a user a more youthful and healthy look. However, the above-described devices are disadvantageous because they require a user to manually exert energy, thereby mitigating the tension relief qualities typically associated with a massage. Thus, it would be preferable to have a hands-free face massaging device.

A need also exists for a device to assist with the topical application of creams, soaps, and cleansers to the face. Typically, creams and cleansers are accompanied by instructions that require a person to dampen his or her face and massage a predetermined amount of the substance into the face using hands, a wash cloth, or a luffa for a predetermined length of time before rinsing the material away. Alternatively, a person can use a handheld face massager or the like to massage these substances into the face. While these substances generally help clean and moisturize a face, there are several limitations. First, it is difficult to apply the substance evenly and ensure that it is equally distributed and massaged into different areas of the face. Second, the massaging elements are often large, making it difficult to massage the substance into the area surrounding the eyes without causing damage. The area around the eyes is prone to wrinkles and other blemishes and is most in need of the cleanser or moisturizer. Third, a person must manually direct the massaging element to each portion of the face, increasing the possibility that some areas of the face will be missed. Thus, the current handheld massagers are not ideal for applying soaps and creams to the face.

In view of the above, it is an object of the invention to provide a hands free apparatus for stimulating, rejuvenating and massaging the face.

It is a further object of the invention to provide a hands free apparatus that can massage substances into the face.

SUMMARY OF THE INVENTION

The invention relates to an apparatus for stimulating, rejuvenating and/or massaging the face.

The apparatus preferably includes a pad having a front surface and a back surface and at least one side surface extending therebetween. The at least one side surface preferably comprises four side surfaces that define a substantially rectangular shape. The pad preferably is made out of a foam or other soft resilient material that can deform, but will return resiliently to a specified shape. The front surface of the pad includes a concavity that will generally conform to the shape and size of a human face. For example, the concavity in the front surface of the pad may be substantially oval. Thus, a person can insert his or her face into the concavity. The foam of the pad will conform to the specific shape of the face to achieve substantially surface-to-surface contact between the face and the portion of the front surface of the pad that defines the concavity. A substantially planar area may extend out from the concavity on the front surface of the pad to the side surface thereof. The rear surface of the pad can take any shape. However, forming the pad may be facilitated if the pad is of substantially uniform thickness. Hence, the rear surface of the pad preferably has a convex region that is opposite the concavity in the front surface. The thickness of the pad from the front surface to the rear surface preferably is in a range of about 2-8 cm.

At least one pad breathing hole preferably extends through the pad from the front surface to the rear surface. More particularly, the at least one pad breathing hole preferably extends from a part of the concavity that will register with the nose of the person using the apparatus. The pad breathing opening also is dimensioned to comfortably receive the nose of the person using the apparatus. Alternatively or additionally, the at least one pad breathing hole may be disposed in the concavity to substantially register with the mouth of the person using the apparatus.

The pad further includes at least one pad stimulator opening and preferably a plurality of pad stimulator openings for accommodating electrical, electro-mechanical, hydraulic or pneumatic means for stimulating and/or rejuvenating the skin of the face. The pad stimulator opening extends from the front surface in the concavity to the rear surface or to the side surface. Plural pad stimulator openings preferably are disposed to substantially align with areas of the face that are likely to be desired target areas for stimulation and/or rejuvenation. For example, pad stimulator openings may be disposed to substantially align with the cheeks, the forehead and/or the chin. The shapes of the pad stimulator openings are selected to conform to the shapes of the specific stimulators that will be employed as explained further herein.

The facial rejuvenating apparatus preferably further includes a base with a top surface having a depression that conforms to the size and shape of the side surfaces and the rear surface of the pad. Thus, the pad can be nested into the depression in the base. In a preferred embodiment, the depression includes a concavity conforming to the convex area on the rear surface of the pad. The base further includes at least one base breathing opening that will register with the pad breathing opening in the pad. The base breathing opening communicates with ambient surroundings so that a person using the apparatus can breathe freely. The base also includes at least one base stimulator opening that preferably substantially registers with the at least one pad stimulator opening in the pad.

The base preferably is adjustable with respect to height and/or angle to accommodate the size and/or position of the person using the apparatus. For example, the base may be mounted pivotally to a frame that can be supported on a horizontal surface, such as a table.

The facial rejuvenating apparatus further includes at least one stimulator and preferably a plurality of stimulators. Each stimulator extends through the base stimulator opening and is mounted in the pad stimulator opening. The stimulators may comprise at least one vibrating stimulator that is electrically powered. Wires for powering the stimulator preferably extend to the base and to an external power cord. Controls for controlling the vibration of the vibrators may be mounted in a side wall of the base. The controls preferably include an on/off switch. However, other controls such as a timer or means for controlling the amplitude or frequency of the vibrations may be provided. The stimulators alternatively or additionally may include at least one heater and/or at least one source of moisture.

The facial rejuvenating apparatus further includes a non-porous rubber or plastic lining that is removably positionable in the concavity of the pad. The lining preferably has a convex rear surface that conforms generally to the shape of the concavity in the pad and a concave front surface. The lining preferably is formed from silicone and is sufficiently deformable to conform to the shape of the face of the person using the apparatus. The lining includes at least one lining breathing opening that registers with the pad breathing opening, but does not require openings that register with the pad stimulator openings. However, certain embodiments may have perforations so that moisture can be delivered from a moisturizing stimulator in the base, through the pad and to the face of the person using the apparatus.

The pad and the base of the apparatus may be preassembled to define a subassembly that is disassembled only for periodic repair, maintenance or cleaning. The lining, however, preferably is removed with each use of the apparatus. More particularly, the convex rear surface of the lining preferably is nested into the concavity in the base. A moisturizing cream may be applied to the concave surface of the lining. The person then positions his or her face in the concave area of the lining and operates the controls to stimulate the face. The stimulation may include vibration, heat and/or moisture.

DETAILED DESCRIPTION OF THE PREFERRED EMBODIMENT

Figure 1:
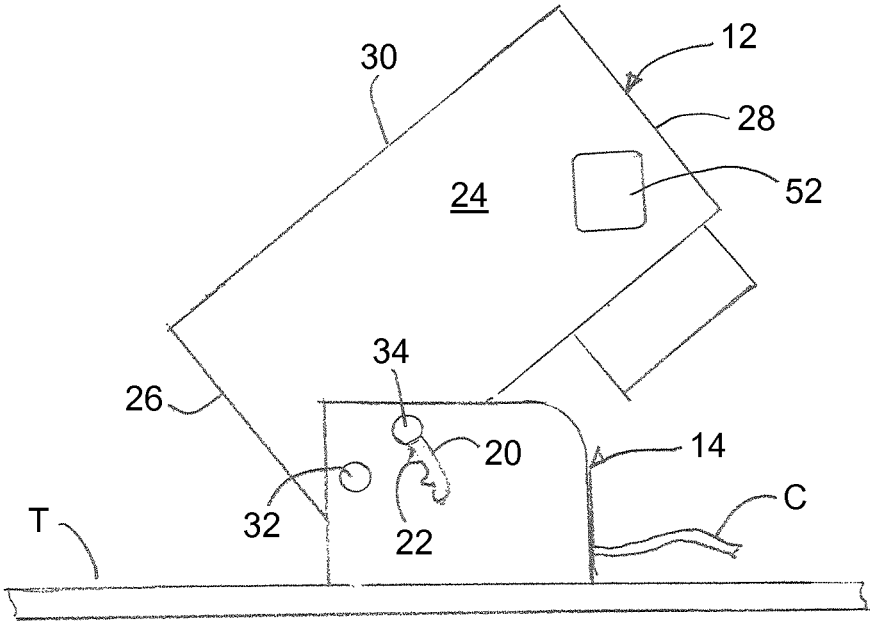
FIG. 1 is a side elevational view of the base and frame of the apparatus of the invention.
Figure 2:
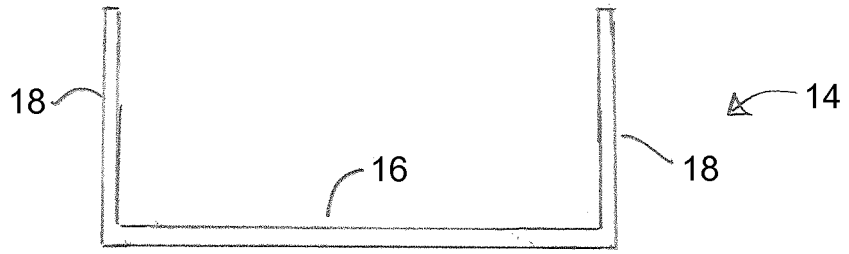
FIG. 2 is a front elevational view of the frame shown in FIG. 1
Figure 8:
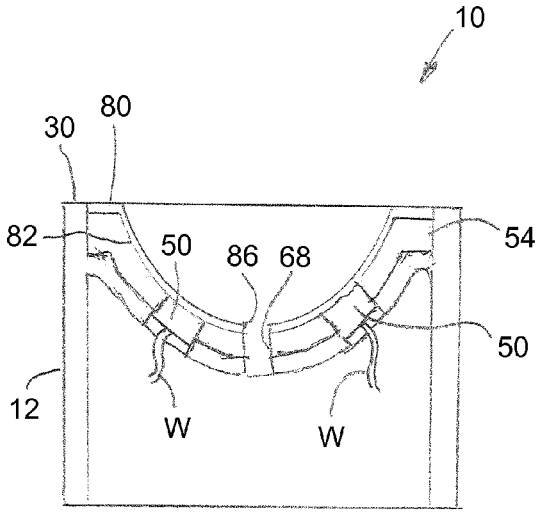
FIG. 8 is a cross-sectional view taken along line 8-8 in FIG. 7 and showing the lining nested into the concavity in the pad.

A facial rejuvenating apparatus in accordance with the invention is identified generally by the numeral 10 in FIGS. 1 and 8. The facial rejuvenating apparatus 10 includes a base 12 and a support 14. The support 14 is configured for mounting on a table T and the base 12 is adjustably supported on the support 14 to adjust the angular orientation of the base 12 relative to the table T. More particularly, the support 14 is a substantially U-shaped structure with a bottom wall 16 and side walls 18 projecting substantially perpendicularly up from the bottom wall 16 and hence substantially parallel to one another as shown in FIG. 2. Each side wall 18 is formed with an arcuate groove 20 having notches 22 formed therein.

The base 12 is a substantially box-shaped structure with opposite side surfaces 24 spaced from one another by a distance slightly less than the spacing between the side walls 18 of the support 14. The base 12 also includes a front surface 26, a rear surface 28 and a top 30. Parts of the sidewalls 24 near the front surface 26 of the base 12 are mounted pivotally to the sidewalls 18 of the frame about pivot pins 32. The pivot pins 32 are disposed substantially concentrically with respect to the arcuate grooves 20. The base 12 further includes adjustment handles 34 projecting out from the sidewalls 24 of the base 12. The adjustment handles 34 can travel through the arcuate grooves 20 as the base 12 pivots relative to the support 14 and can be releasably engaged with the notches 24 when the base 12 is at a desired angular orientation relative to the support 14.

The top 30 of the base 12 includes a peripheral frame 36 and a depression 38 inward of the peripheral frame 36. The depression 38 includes a generally planar portion 40 adjacent the peripheral frame 36 and a substantially oval base concavity 42 inward of the planar portion 40. The base concavity 42 is larger than the size of the typical human face and includes a base breathing opening 44 that extends through the base 12 to areas external of the base 12 for providing communication with ambient air surrounding the apparatus 10. The base concavity 42 also includes a base forehead stimulator opening 46 and base cheek stimulator openings 48.

Figure 3:
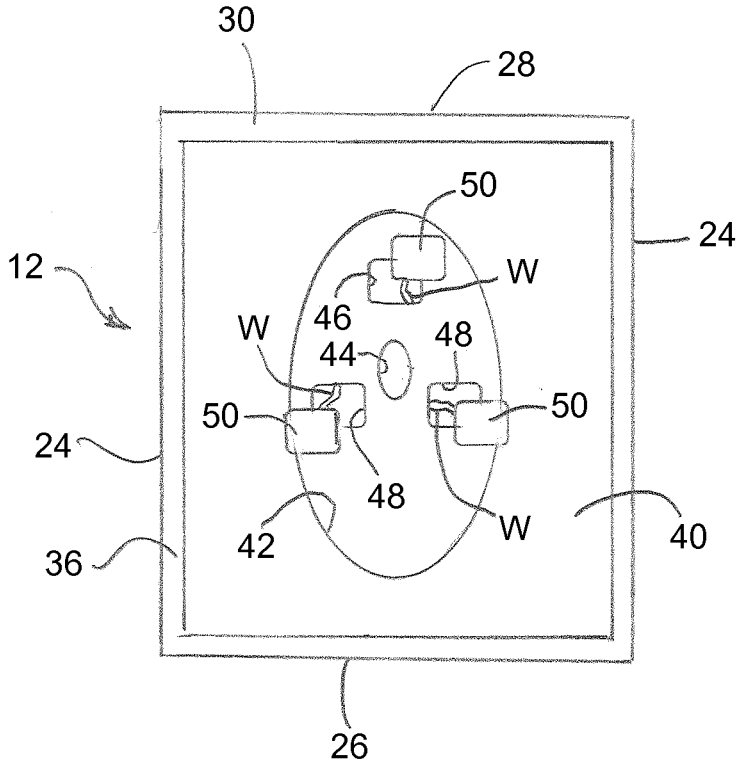
FIG. 3 is a top plan view of the base with the stimulators projecting therefrom.

Stimulators 50 project through the base stimulator openings 46 and 48 and into the base concavity 42. The stimulators 50 in the illustrated embodiment are electrically powered vibrators. Wires for delivering power to the vibrators 50 are identified generally by the letter W in FIG. 3. A power cable C is connected to the wires W inside the base and to a control unit 52 that is accessible on one of the sidewalls 24 or on the front surface 26 of the base 12. The control unit 52 preferably includes an on/off switch, timing controls and controls for adjusting the amplitude and/or frequency of vibrations. The power cable C is connectable to an external power source. Although the stimulators 50 illustrated and described herein are vibrators, the stimulators 50 may comprise heaters and/or moisture generators.

Figure 4:
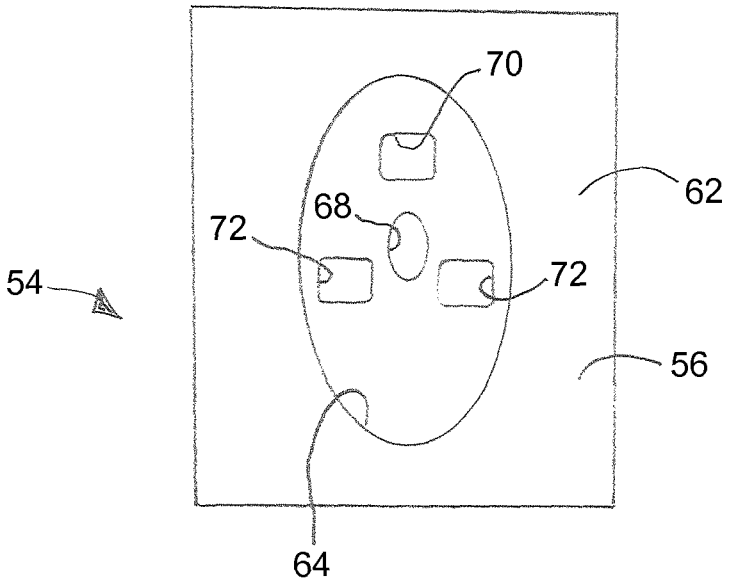
FIG. 4 is a top plan view of the pad.
Figure 5:
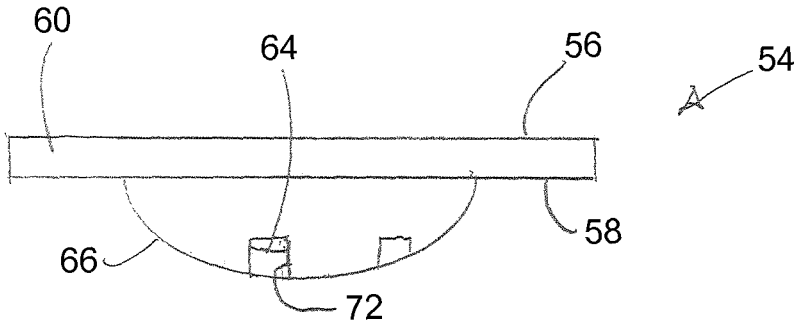
FIG. 5 is a side elevational view of the pad.
Figure 6:
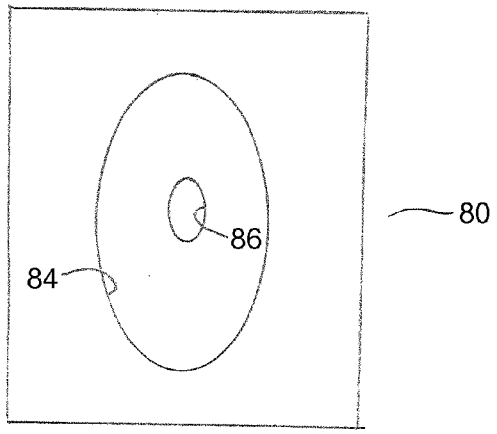
FIG. 6 is a bottom plan view of the lining.
Figure 7:
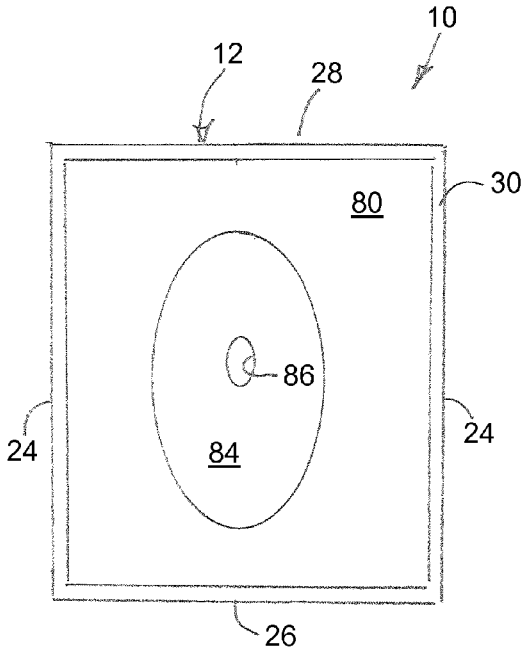
FIG. 7 is a top plan view of the base, pad and stimulators in their assembled condition.

The facial rejuvenating apparatus 10 further includes a pad 54, as shown most clearly in FIGS. 4 and 5. The pad 54 includes a top surface 56, a bottom surface 58 and side surfaces 60. The pad 54 preferably is formed from a soft resilient foam. Parts of the top surface 56 adjacent the side surfaces 60 define a generally planar area 62. However, a concavity 64 is formed in the top surface 56 inward of the planar area 62. The concavity 64 generally conforms to the size and shape of a human face, and hence is substantially oval. The bottom surface 58 includes a convex region 66 opposite the concavity 64. The convex region 66 is dimensioned to substantially nest with the base concavity 42 in the base 12.

The pad 54 includes a pad breathing opening 68 extending therethrough at a location to register with the base breathing opening 44. However, the pad breathing opening has an upwardly facing region that is configured to nest with the nose of a person using the apparatus 10. The pad 54 also includes a pad forehead stimulator opening 70 and pad cheek stimulator openings 72 that register with the base forehead stimulator opening 46 and the base cheek stimulator openings 48 respectively. The pad forehead stimulator opening 70 and the pad cheek stimulator openings 72 are configured to receive the stimulators 50.

The facial rejuvenating apparatus 10 further includes a lining 80 formed from 18 flexible nonporous material and preferably from silicone having a thickness that preferably is less than 1 cm, and most preferably about 0.5 cm. The lining 80 has a convex lower surface 82 configured to nest with the concavity 64 of the pad 54 and a concave upper surface 84 opposite the lower surface. The lining 80 further includes a lining breathing opening 86 disposed to register with the pad breathing opening 68 and the base breathing opening 44. The lining 80, however, does not include openings for receiving the stimulators 50. However, in certain embodiments, parts of the lining 80 may include perforations to accommodate a flow of moisture through the lining 80.

The base 12, the frame 14 and the pad 54 of the rejuvenating facial apparatus 10 typically are preassembled to define a subassembly that will be disassembled only periodically for repair, maintenance or cleaning. The lining 80, however, will be replaced after each use. More particularly, the convex lower surface 82 of the lining 80 is nested in the concavity 64 of the pad 54. A moisturizing cream or other flowable solution may be applied to the concave upper surface 84 of the lining 80. The base 12 may be adjusted to an appropriate angle relative to the support 14 that is comfortable for the user. The user then places his or her face in the concave upper surface 84 of the lining and turns the apparatus 10 on by using the controls of the control unit 52. The vibrators 50 will generate vibrations of the foam pad and the lining 80 that can be felt across the entire face, and particularly in the forehead and cheek areas. Upon completion of the use of the rejuvenating facial apparatus 10, the user or an operator will remove the lining 80 and clean at least the concave upper surface 84 of the lining 84 a subsequent use.

Although the disclosure herein has been described with reference to particular illustrative embodiments, it is to be understood that these embodiments are merely illustrative of the principles and applications of the present disclosure. Therefore numerous modifications may be made to the illustrative embodiments and other arrangements may be devised without departing from the spirit and scope of the present disclosure, which is defined by the appended claims.

What is claimed is:

1. A facial rejuvenating apparatus, comprising:

a support configured to be supported on a horizontal surface;

a base having a depression, the base being mounted to the support at an acute angle to the horizontal surface;

a soft resilient pad having an upper surface formed with a concavity therein configured to receive a human face, at least one pad breathing opening formed through the pad, the pad being nested in the depression of the base;

at least one stimulator mounted in the pad in proximity to the concavity in the pad, the stimulator comprising at least one vibrator and at least one heater; and a nonporous lining removably nested with the pad and having at least one lining breathing opening substantially registered with the pad breathing opening.

2. The facial rejuvenating apparatus of claim 1, wherein the stimulator is and electrically powered vibrator.

3. The facial rejuvenating apparatus of claim 1, wherein the stimulators are disposed in the pad to substantially register with cheeks of a person using the apparatus.

4. The facial rejuvenating apparatus of claim 3, wherein the stimulators further comprise at least one stimulator disposed in the pad to substantially register with a forehead of a person using the apparatus.

5. The facial rejuvenating apparatus of claim 1, wherein the lining is formed from silicone.

6. The facial rejuvenating apparatus of claim 1, wherein the base includes a base breathing opening substantially registered with the pad breathing opening and providing communication to ambient air.

7. The facial rejuvenating apparatus of claim 6, wherein the base further includes at least one base stimulator opening for accommodating the at least one stimulator.

8. The facial rejuvenating apparatus of claim 7, wherein the stimulator is electrically powered, and wherein the base includes a control unit for controlling operation of the at least one stimulator.

* * * * *